United States Patent [19]

Borrow

[11] Patent Number: 4,575,272

[45] Date of Patent: Mar. 11, 1986

[54] TOOTHPASTE APPLICATOR ON A DRINKING STRAW

[76] Inventor: Edgar W. Borrow, Padnell Grange, Cowplain, Portsmouth, Hampshire, England

[21] Appl. No.: 643,549

[22] Filed: Aug. 23, 1984

[30] Foreign Application Priority Data

Sep. 3, 1983 [GB] United Kingdom ..... 8323687

[51] Int. Cl.[4] ..... A46B 11/00

[52] U.S. Cl. ..... 401/195; D7/42; 15/167 R; 215/1 A; 229/1.5 R; 239/33; 401/268

[58] Field of Search ..... 401/195, 268; D7/42; 15/110, 167 R, 104.94; 215/1 A; 229/1.5 R; 206/90.2; 239/33

[56] References Cited

U.S. PATENT DOCUMENTS

| | | | |
|---|---|---|---|
| D. 84,064 | 4/1931 | Trumbull | D7/42 X |
| 1,606,038 | 11/1926 | Norman | D7/42 R X |
| 2,028,519 | 1/1936 | Peterkin et al. | 15/167 R |
| 2,334,535 | 11/1943 | Bandell | D7/42 X |
| 3,068,571 | 12/1962 | Thompson | 15/104.94 |
| 3,406,868 | 10/1968 | Rogers | D7/42 X |
| 3,536,410 | 10/1970 | Wargoe | 401/268 X |
| 3,925,890 | 12/1975 | Frodsham | D7/42 |

*Primary Examiner*—Steven A. Bratlie

*Attorney, Agent, or Firm*—Leydig, Voit & Mayer, Ltd.

[57] ABSTRACT

A toothpaste applicator comprises an applicator head formed on one end of a drinking straw. The head preferably comprises a pair of wing-shaped portions adapted to retain toothpaste, with a removable cover strip. The head may be textured on its convex and/or concave surfaces for effecting a brushing action in use.

4 Claims, 3 Drawing Figures

TOOTHPASTE APPLICATOR ON A DRINKING STRAW

BACKGROUND OF THE INVENTION

Field of the Invention

This invention relates to a toothpaste applicator.

SUMMARY OF THE INVENTION

In accordance with the present invention there is provided a toothpaste applicator which comprises an applicator head formed on, or otherwise securely attached to, one end of a drinking straw.

Beverages are currently marketed in disposable rectangular-section packs to the outside of which is attached a disposable drinking straw, and in its preferred form, the toothpaste applicator according to the present invention could be used in substitution for the plain drinking straw.

DESCRIPTION OF THE DRAWINGS

One embodiment of a toothpaste applicator according to the invention is shown, by way of example, in the accompanying drawings in which.

DESCRIPTION OF THE PREFERRED EMBODIMENT

Figure 1:
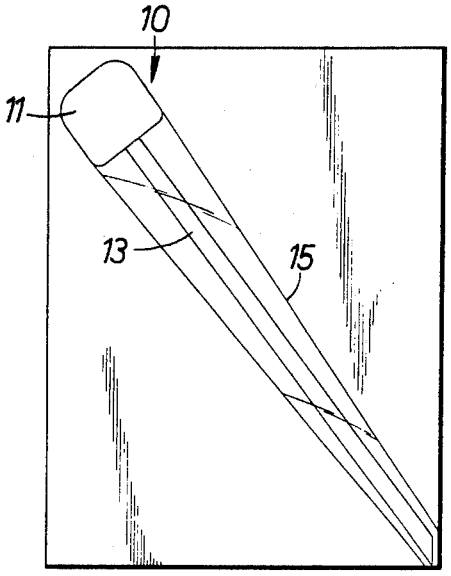
FIG. 1 is a side view of a beverage pack to one side of which is attached a toothpaste applicator according to the present invention.
Figure 2:
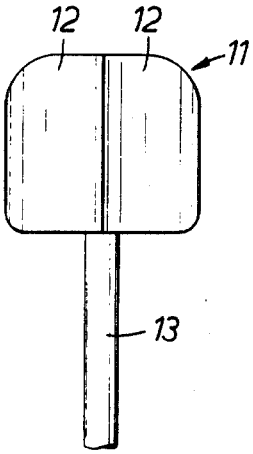
FIG. 2 is a side view, on an enlarged scale, of the head of the toothpaste applicator
Figure 3:
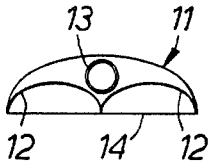
FIG. 3 is an end view of the applicator.

As shown in the drawings, the applicator 10 comprises a head 11 formed on, or otherwise securely attached to, a drinking straw 13. The head 11, which conveniently is a plastics moulding, comprises a pair of wing-shaped portions 12 each of which extends away from the straw on opposite sides thereof, each being concave on one face and convex on the opposite face. The convex faces together define a single convex surface. The straw 13 is located in the plane of symmetry of the applicator.

The concave faces of wing portions 12 are shaped to fit the average shape of two adjacent front teeth of a child aged 6–7 years. On to each concave face a layer of toothpaste is deposited after which a suitable cover strip 14 can be applied over the toothpaste to prevent inadvertent removal.

The concave face of each wing portion 12 can be formed with transverse ribs or be otherwise textured or roughened to assist in holding the toothpaste in position and to assist in effecting a brushing action when the applicator is in use. The convex surface of the wing portions 12 can also be textured or roughened.

The applicator has been designed for children, particularly of ages 6–7.

In use, the child will detach the applicator from the pack and, after removal of its plastic wrapping 15, will use the straw of the applicator to drink the contents of the pack. Thereafter it is intended that the child will remove the cover strip 14, place the applicator's concave side against his/her teeth and clean the teeth by an upward and downward brushing-type action. After applying the concave side to coat the teeth with toothpaste, the convex side may be applied to the teeth to obtain more localised brushing action.

It is proposed that the toothpaste may be suitably flavoured to encourage the child to use the applicator. By shaping the applicator in the way illustrated and described above, it is believed that the child will be encouraged to use the up-and-down action, rather than a side-to-side action which tends to be used with a conventional toothbrush.

The present invention is however not intended to replace normal teeth cleaning with a conventional toothbrush.

In manufacture the applicator head may be formed integrally with the drinking straw from plastics material. The toothpaste can conveniently be a fluoridated toothpaste. If however the beverage is fluoridated, for example fluoridated milk containing one part per million of fluoride, there will be no need to use fluoridated toothpaste.

The term toothpaste as used herein is intended to include cream foam dentifrices which can, if required, contain fluoride.

I claim:

1. A toothpaste applicator comprising an applicator head formed on, or otherwise securely attached to, one end of a drinking straw, the applicator head comprising a pair of wing-shaped portions extending away from the straw on opposite sides thereof, each portion being concave on one face and convex on the opposite face, and the concave faces being configured and textured to assist in retaining toothpaste and to assist in effecting a brushing action in use.

2. A toothpaste applicator according to claim 1, wherein the convex faces are textured to assist in a localised brushing action in use.

3. A toothpaste applicator according to claim 1, containing toothpaste in the wing-shaped portions and comprising a removable cover strip over the toothpaste.

4. A disposable beverage pack and a toothpaste applicator comprising an applicator head formed on, or otherwise securely attached to, one end of a drinking straw, the applicator head comprising a pair of wing-shaped portions extending away from the straw on opposite sides thereof, each portion being concave on one face and convex on the opposite face and containing toothpaste, and a removable cover strip over the toothpaste.

* * * * *